US006220520B1

(12) United States Patent
Gibbs

(10) Patent No.: US 6,220,520 B1
(45) Date of Patent: Apr. 24, 2001

(54) MANIFOLDS FOR USE IN WATER HEAT DISTRIBUTION SYSTEMS

(75) Inventor: Donald R. Gibbs, Vernon (CA)

(73) Assignee: Tekmar Holdings Ltd., Vernon (CA)

( * ) Notice: Subject to any disclaimer, the term of this patent is extended or adjusted under 35 U.S.C. 154(b) by 0 days.

(21) Appl. No.: 09/471,096

(22) Filed: Dec. 23, 1999

(51) Int. Cl.[7] ..... F24D 3/00
(52) U.S. Cl. ..... 237/8 R; 237/8 A; 237/19
(58) Field of Search ..... 237/8 R, 8 A, 237/19, 59, 63

(56) References Cited

U.S. PATENT DOCUMENTS 1,993,685 * 3/1935 Rosenblad ..... 237/8 R
2,559,253 * 7/1951 Lingen et al. ..... 237/8 R
4,601,426 * 7/1986 Brosenius ..... 237/59
4,679,729 7/1987 Petitjean et al. ..... 237/8 R
5,119,988 * 6/1992 Fiedrich ..... 237/59
5,617,994 4/1997 Fiedrich ..... 237/8 R

OTHER PUBLICATIONS

Publication MultiTherm by Roth Heating Fall 1998.

* cited by examiner

*Primary Examiner*—Harold Joyce
*Assistant Examiner*—Derek S. Boles
(74) *Attorney, Agent, or Firm*—Robert F. Delbridge

(57) ABSTRACT

A modular manifold includes master modules and possibly also slave modules which each provide a respective terminal unit with a relatively constant rate of water flow at a modulated supply water temperature.

35 Claims, 15 Drawing Sheets

MANIFOLDS FOR USE IN WATER HEAT DISTRIBUTION SYSTEMS

This invention relates to hydronic (hot water) heating systems for buildings, and in particular to manifolds therefor.

BACKGROUND OF INVENTION

Hydronic heating systems mix hot water from a source thereof, such as a boiler, with cooler water returning from terminal units in order to regulate the temperature of supply water flowing to the terminal units. Many such systems have been proposed and some are in commercial use. However, because of difficulties arising from the fact that different terminal units and different zones of a building normally require difficult supply water temperatures, a need still exists for a hydronic heating system which achieves such requirements in an improved manner.

It is therefore an object of the present invention to provide an improved hydronic heating system for buildings.

SUMMARY OF THE INVENTION

The present invention provides a modular manifold which includes master modules and possibly also slave modules which each provide a respective terminal unit with a relatively constant rate of water flow at a modulated supply water temperature.

DESCRIPTION OF THE DRAWINGS

Embodiments of the invention will now be described, by way of example, with reference to the accompanying drawings, of which.

DESCRIPTION OF PREFERRED EMBODIMENTS

Figure 1:
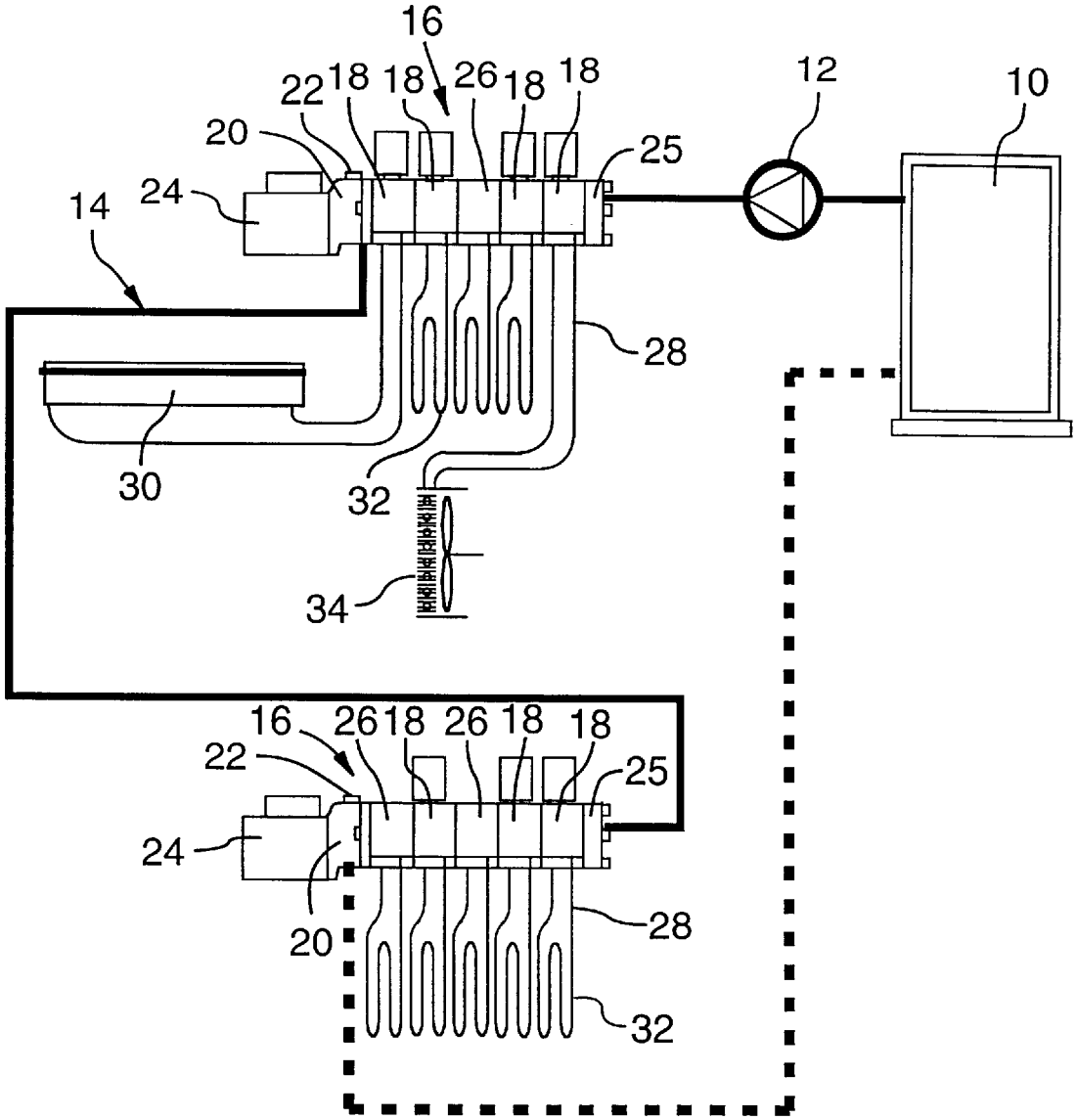
FIG. 1 is a schematic view of a hydronic heating system in accordance with one embodiment of the invention.

Referring to the drawings, FIG. 1 shows a hydronic heating system in which hot water is pumped from a hot water source such as a boiler 10 by a pump 12 through a primary loop 14 which includes a series of temperature controlled manifold assemblies 16, with water from the last manifold assembly being returned to the boiler 10. Each manifold assembly 16 has several master modules 18, a motor end module 20 with an air vent 22 and a single pump motor 24, and an end plate 25. One or more slave modules 26 may also be included. Tubing 28 connects one or more terminal units to each master or slave module 18, 26. A terminal unit may for example be a convector 30, a radiant floor system 32, a fan coil 34 or other suitable hydronic heating units.

Figure 2:
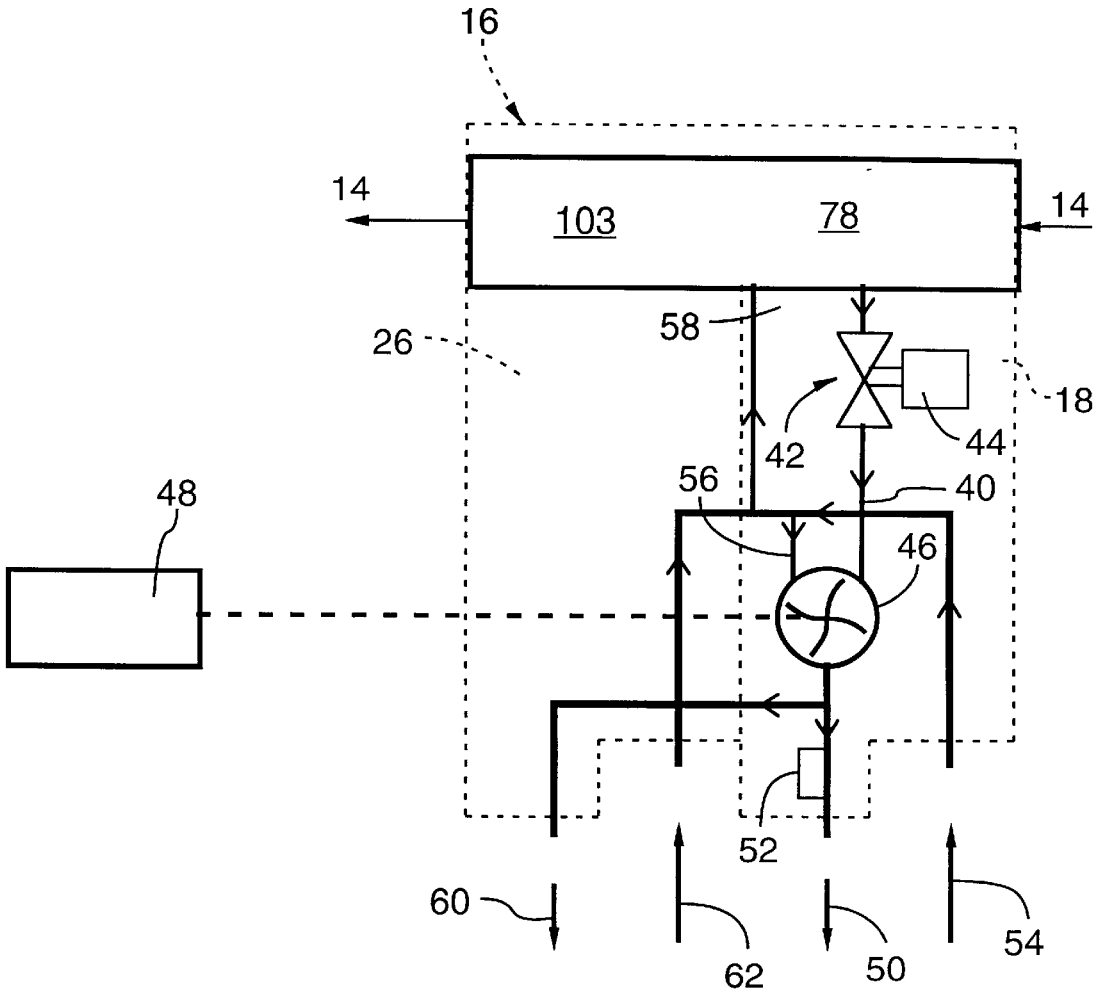
FIG. 2 is a similar view of the hydronic circuit associated with the master and slave modules in a manifold assembly.

FIG. 2 shows the hydronic circuit associated with the master and slave modules 18, 26 in a manifold assembly 16. As previously mentioned, the primary loop 14 passes through each manifold assembly 16. Each master module 18 is supplied with hot water from the primary loop 14 through an injection supply passage 40 which has a primary injection valve 42 operated by an electric motor 44 to throttle the flow of hot water from the primary loop 14. The hot water supplied through injection supply passage 40 is mixed with return water supplied through passage 56 from the master and slave modules 18, 26 by an impeller 46 driven by a motor 48. The mixed flow passes through a passage 50 to a terminal unit, with the temperature of the mixed water in the passage 50 being measured by a supply temperature sensor 52. Mixed water from the impeller 46 also passes from passage 50, upstream of the sensor 52, along passage 60 to another terminal unit.

Cooler return water from the terminal unit passes into a return passage 54. Some of the return water in passage 54 is returned to the impeller 46 through passage 56. The remainder of the return water in passage 54, together with most of any air bubbles in the system, is returned to the primary loop 14 through a passage 58 to balance the flow from the primary loop 14 to the injection valve 42. Cooler return water from the slave module 26 is passed through a return passage 62 to master return pipe 54. The slave module 26 thus operates at the same temperature as the master module 18.

When the injection valve 42 is closed, there is virtually no heat (i.e. hot water) transferred from the primary loop 14 to the master and slave modules 18, 26. Conversely, when the injection valve 42 is fully open, at least 50 percent of the hot water supplied to the master and slave modules 18, 26 will be from the primary loop 14, depending upon the size of the return passage 56.

Figure 3:
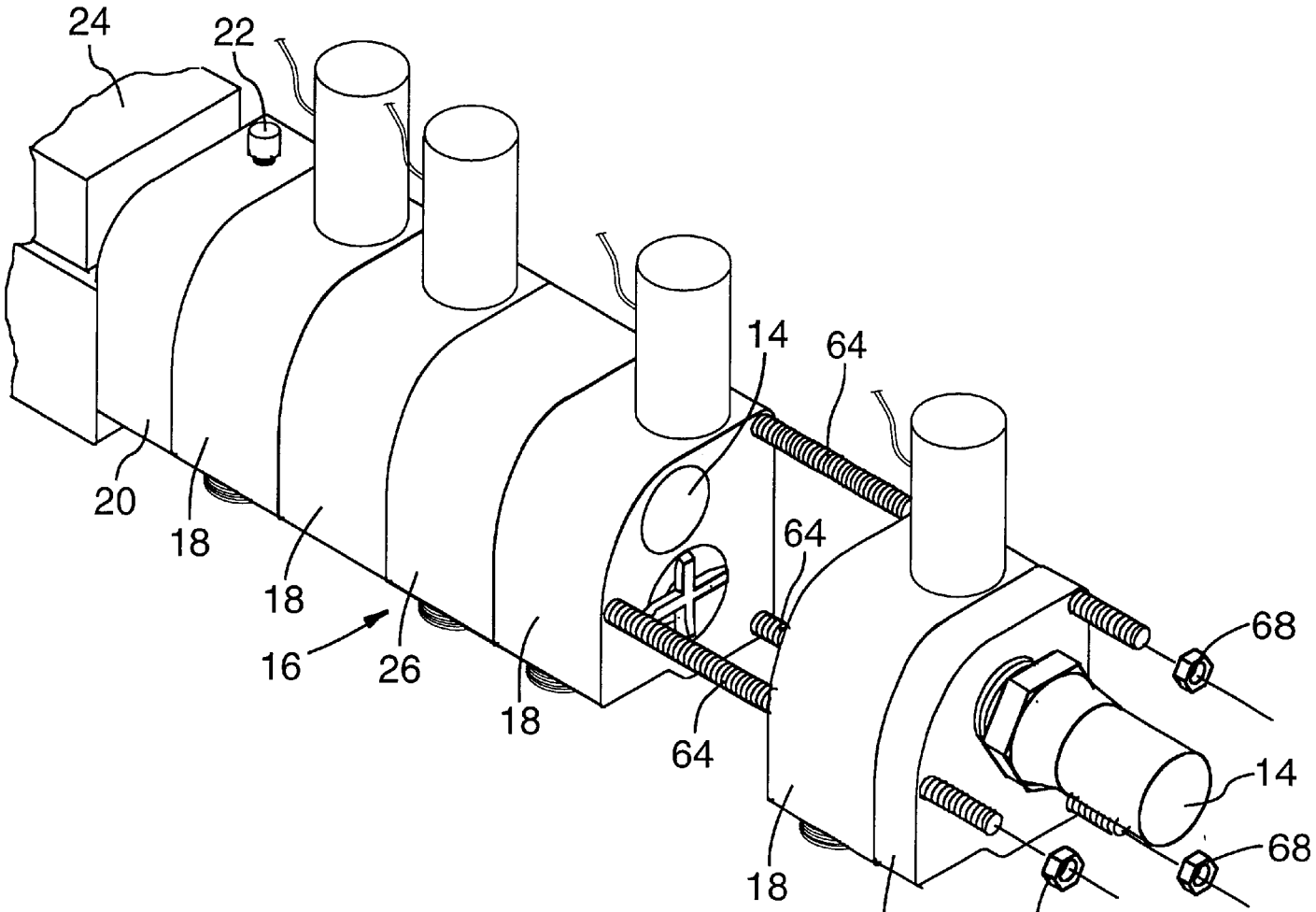
FIG. 3 is a partly exploded perspective view of a manifold assembly in the hydronic heating system of FIG. 1.

FIG. 3 shows the manifold assembly 16 which appears in the upper part of FIG. 1. The various components are held together by threaded rods 64 which extend from the motor end module 20 through bores (not shown) in the components with nuts 68 being threaded on to the ends of rods 64 which project from end plate 25. The end plate 25 is connected to the adjacent portion of the primary loop 14, as also is the end module 20.

Figure 4:
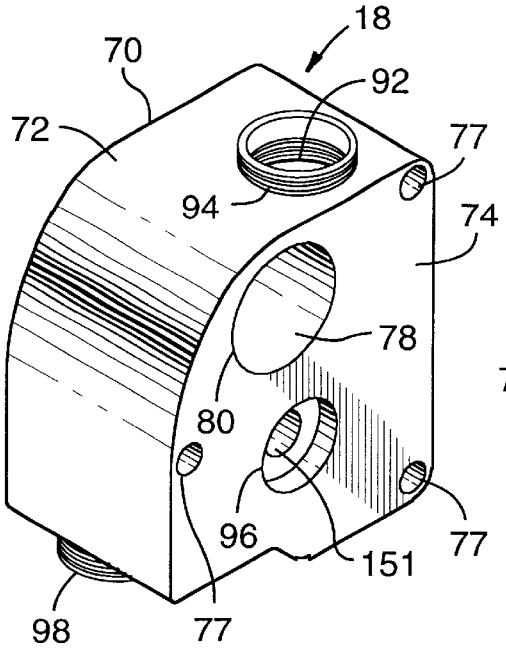
FIG. 4 is a perspective view, generally from the right, of a master module.
Figure 5:
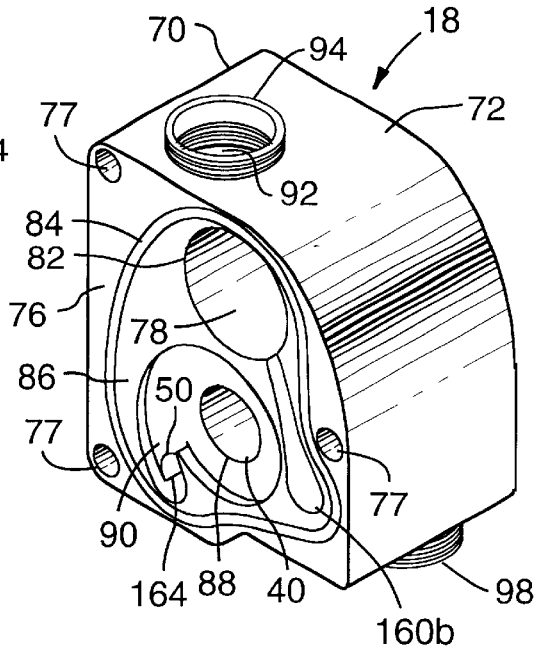
FIG. 5 is a similar view, but generally from the left, of the master module.

As shown in FIGS. 4 and 5, each master module 18 has a main body 70 which is preferably an integral moulding of fibre-reinforced thermoplastic material. The main body 70 has a continuous outer surface 72 extending between a first generally planar side face 74 and a second generally planar side face 76 which extend substantially parallel to one another at opposite ends of the main body 70. The main body 70 has three bores 77 extending therethrough to receive the threaded rods 64 shown in FIG. 3. A first hot water supply conduit 78 in the main body 70 forms a portion of the primary loop 14 and is in fluid communication with an inlet port 80 in the first side face 74 and an outlet port 82 in the second side face 76.

The side face 76 has a continuous groove 84 which receives a sealing ring (not shown) to provide a seal between the side face 76 and a side face of an adjacent module or other component. The groove 84 surrounds a portion 86 of the side face 76 within which the port 82 is located. A further port 88 is located in a recessed portion 90 of side face portion 86 for a purpose which will be described later. The upper part of the outer surface 72 of the main body 70 has an aperture 92 surrounded by a threaded collar 94 to receive a primary injection valve 42, again as will be described later. The end face 74 also has a port 96 for connection with a port of an adjacent component, such as the port 88 in the end face 76 of a master module 18. The lower part of the outer surface 72 of the main body 70 of the master module 18 has an outlet port (not shown in FIGS. 4 and 5) surrounded by a threaded collar 98.

Figure 6:
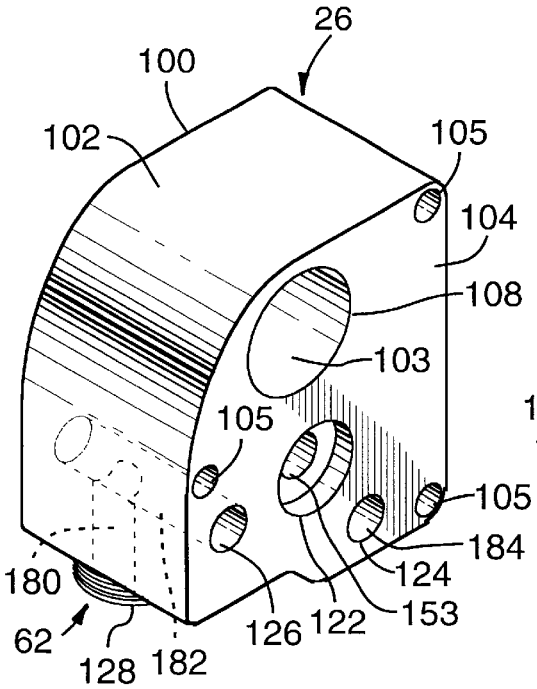
FIG. 6 is a similar view, generally from the right, of a slave module.
Figure 7:
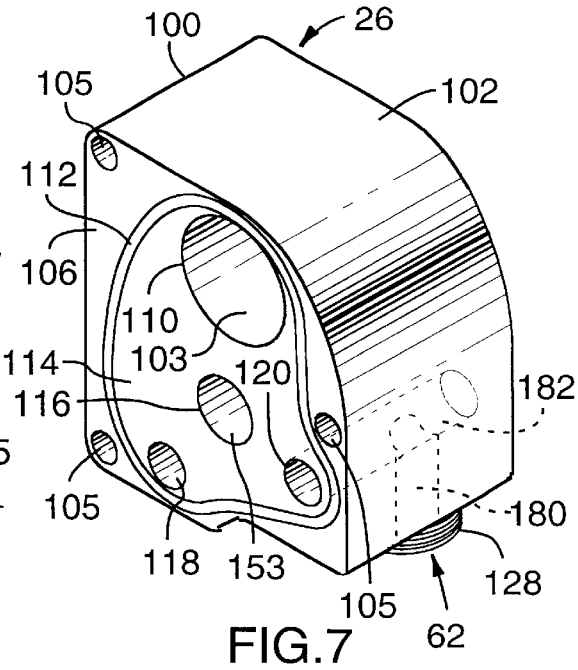
FIG. 7 is a similar view, but generally from the left, of the slave module.

Each slave module 26, as shown in FIGS. 6 and 7, has a main body portion 100 which is also an integral moulding of fibre-reinforced thermoplastic material. The main body 100 has a continuous outer surface 102 extending laterally between a first generally planar end face 104 and a second greatly planar end face 106 oriented substantially parallel to one another at opposite ends of the main body 100. The main body 100 has three passages 105 extending therethrough to receive the threaded rods 64 shown in FIG. 3. A first hot water supply conduit 103 in the main body 100 forms a portion of primary loop 14 and is in fluid communication with an inlet port 108 in the end face 104 and an outlet port 110 in the opposite end face 106.

The side face 106 has a continuous groove 112 which receives a sealing ring (not shown) to provide sealing between the side face 106 and the side face of an adjacent module or other component. The groove 112 surrounds a portion 114 of the side face 106 in which the port 110 is located, with ports 116, 118, 120 also being located therein for a purpose which will be described in more detail later.

The end face 104 also has ports 122, 124, 126 for communication with respective ports in an adjacent component such as the ports 116, 118, 120 in the end face 106 of a slave module 26. The lower part of the outer surface 102 of the main body 100 has an inlet port (not shown in FIGS. 6 and 7) surrounded by an externally threaded collar 128.

Figure 8:
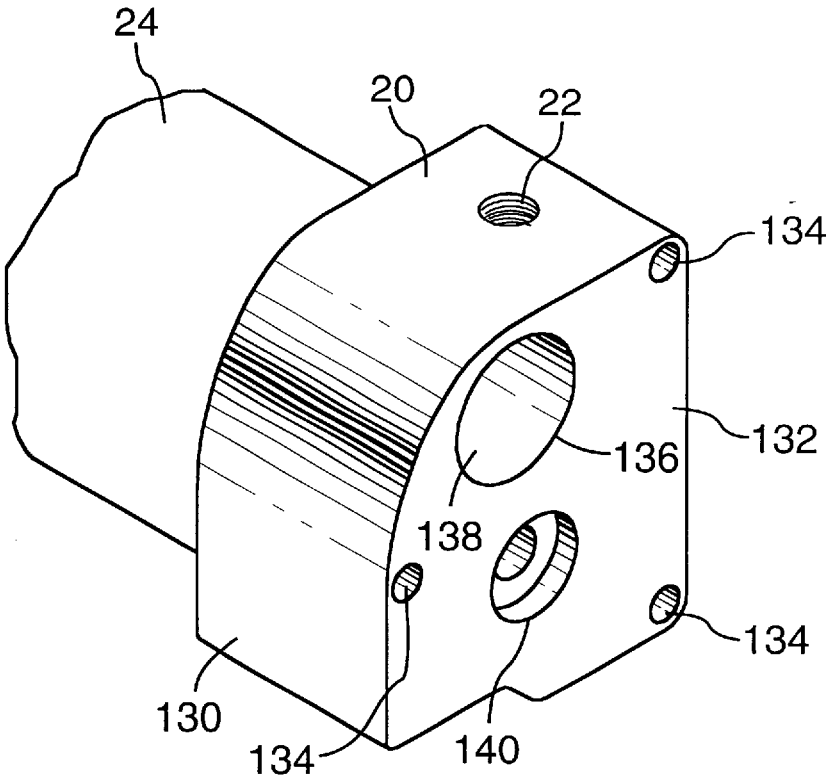
FIG. 8 is a similar view, generally from the right, of a motor end module and pump motor.

A motor end module 20 is shown in FIG. 8 and, as with the master and slave modules 18, 26, is an integral moulding of fibre-reinforce thermoplastic materials. The motor end module 20 has a main body 130 of a similar size and shape as the main bodies 70, 102 of the master and slave modules 18, 26 respectively. The end module 22 also has an end face 132 from which three passages 134 extend to retain the screw threaded rods 64. The end face 132 has an inlet port 136 from which a hot water passage 138 extends to form a portion of the primary loop 14. The end face 132 also has a further port 140 positioned for communication with the port 88 of a master module 18 or the port 116 of a slave module 26. The pump motor 24 is secured to the other end face (not shown) of the end module 20.

Figure 9:
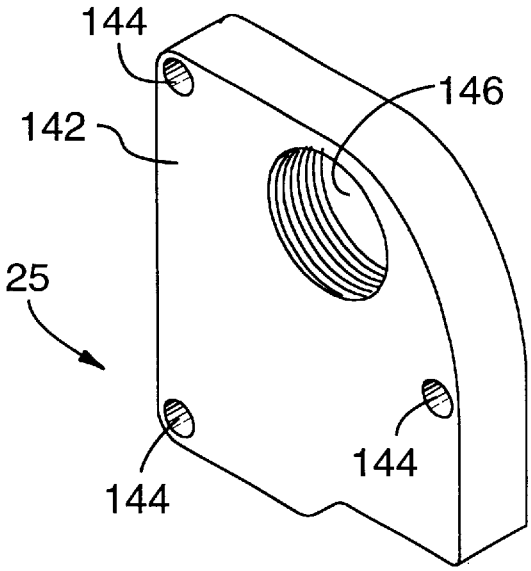
FIG. 9 is a similar view, but generally from the left, of an end plate.

An end plate 25 is shown in FIG. 9 and is likewise an integral moulding of fibre-reinforced thermoplastic material. The end plate 25 has a body 142 of the same peripheral shape as the main bodies 70, 100, 130 of the master and slave modules 18, 26 and end module 20.

Figure 10:
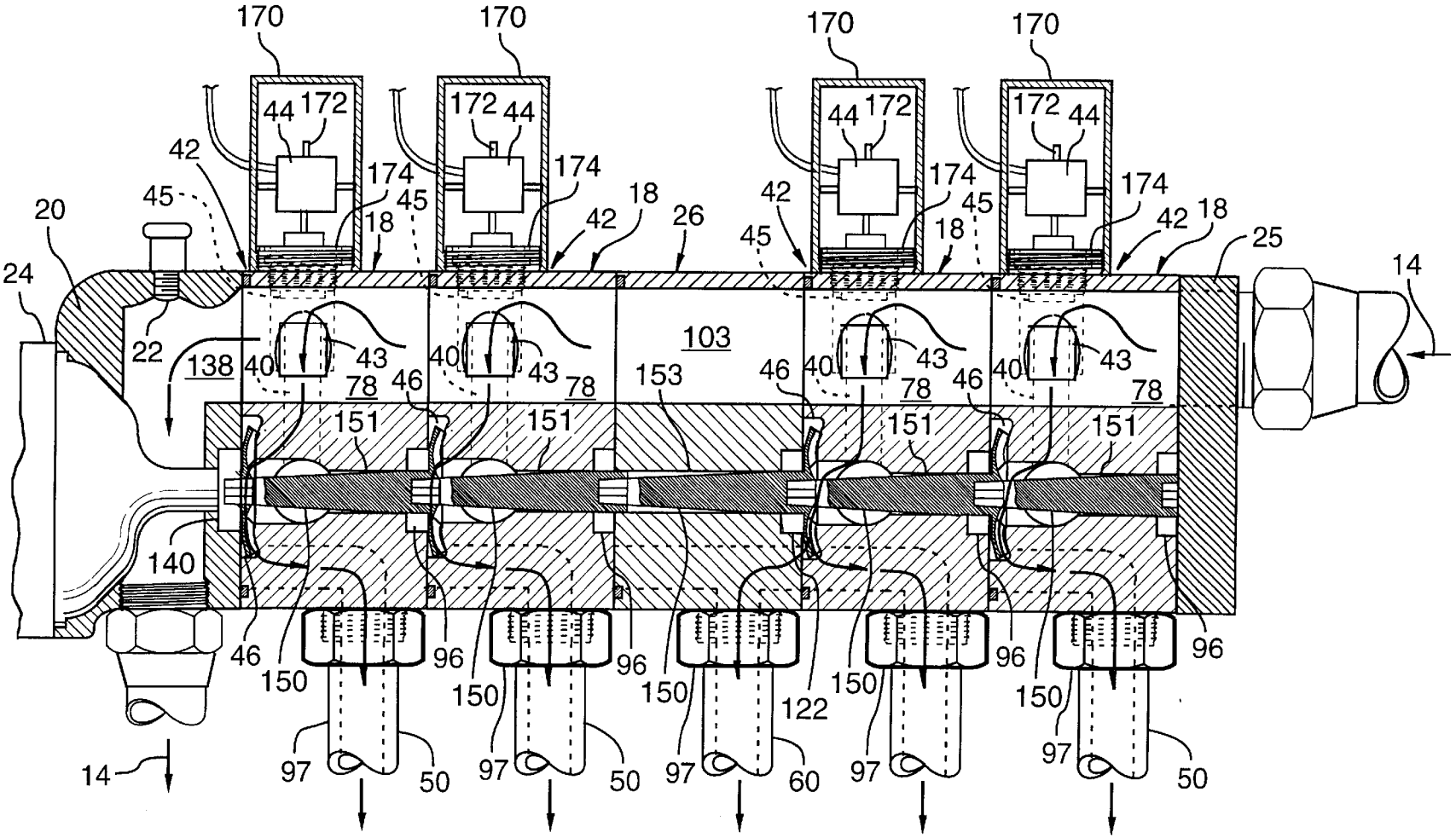
FIG. 10 is a longitudinal sectional view of the upper manifold assembly of FIG. 1 showing the water supply.

The supply flow of hot water through the upper manifold assembly of FIG. 1 is shown in FIG. 10. Hot water in the primary loop 14 flows (from right to left in the drawing) from the pump 12 through passage 146 (not shown in FIG. 10) of the end plate 25, through the passages 78 of the first two master modules 18, through the passage 103 of the slave module 26, through the passage 78 of the next two master modules 18, and through the passage 138 in the end module 20 to proceed along the next portion of the primary loop 14.

In each master module 18, the injection supply valve 42 (as set by its motor 44) determines the amount of hot water fed from the primary loop 14 to the impeller 46 which pumps, together with return water (as will be described in more detail later), hot water through passage 50 to a terminal unit, for example the fan coil 34 shown in FIG. 1. As shown in FIG. 10, the impellers 46 of the master modules 18 are each mounted on a shaft 150 which extends through passages 151, 153 between ports 88, 96 and 116, 122 in the master and slave modules 18, 26 respectively. The shafts 150 are drivingly connected to each other and are journalled in the ports 96, 122 of the master and slave modules 18, 26 respectively. The pump motor 24 is drivingly connected to a first shaft 150 which is journalled in the port 140 of the end module 20.

Figure 11:
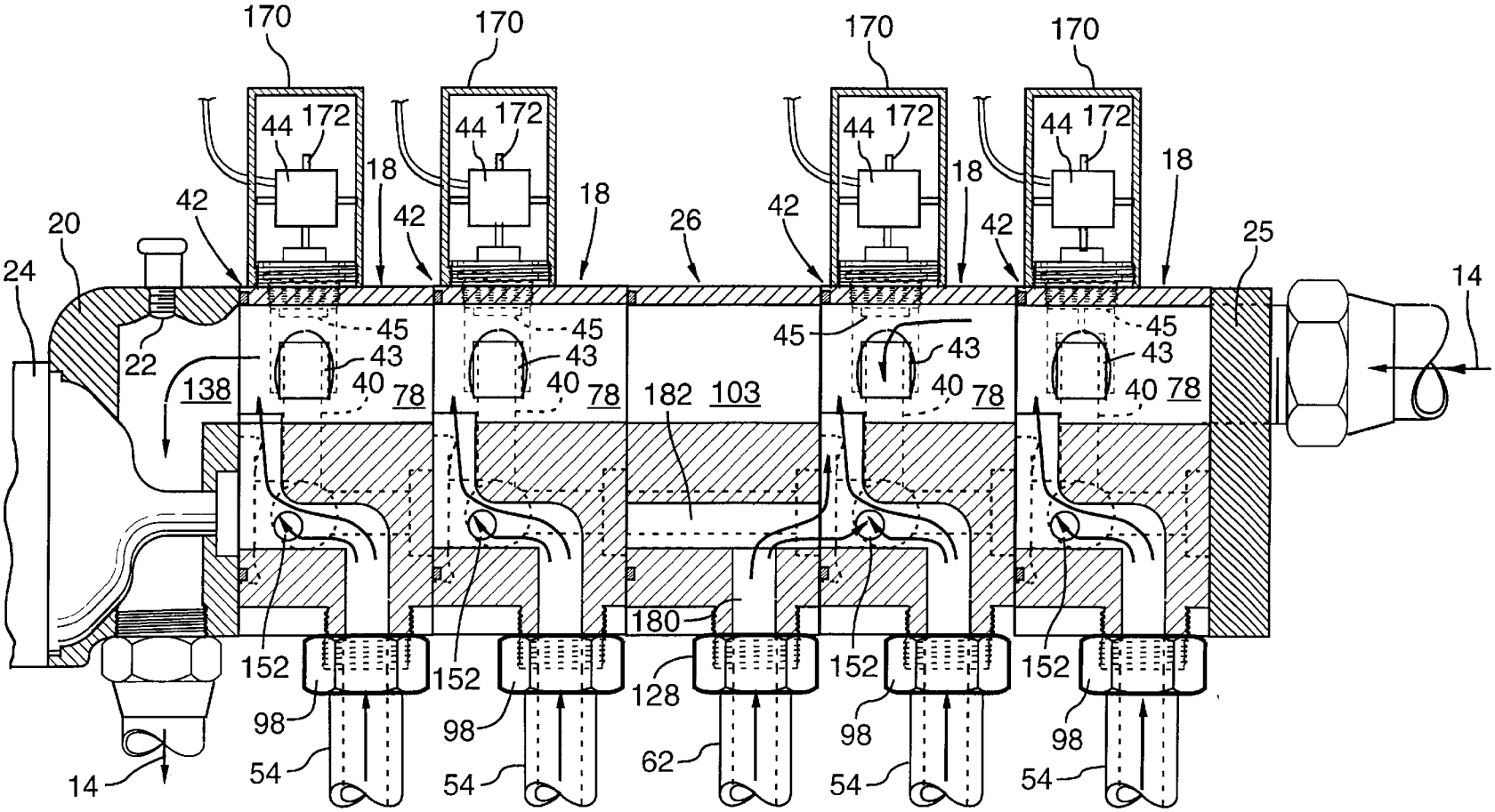
FIG. 11 is a similar view, but showing the water return.
Figure 13:
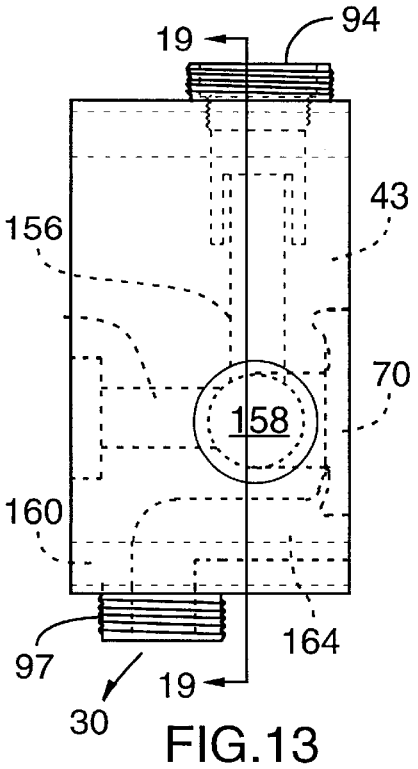
FIG. 13 is a rear view of the master module.
Figure 12:
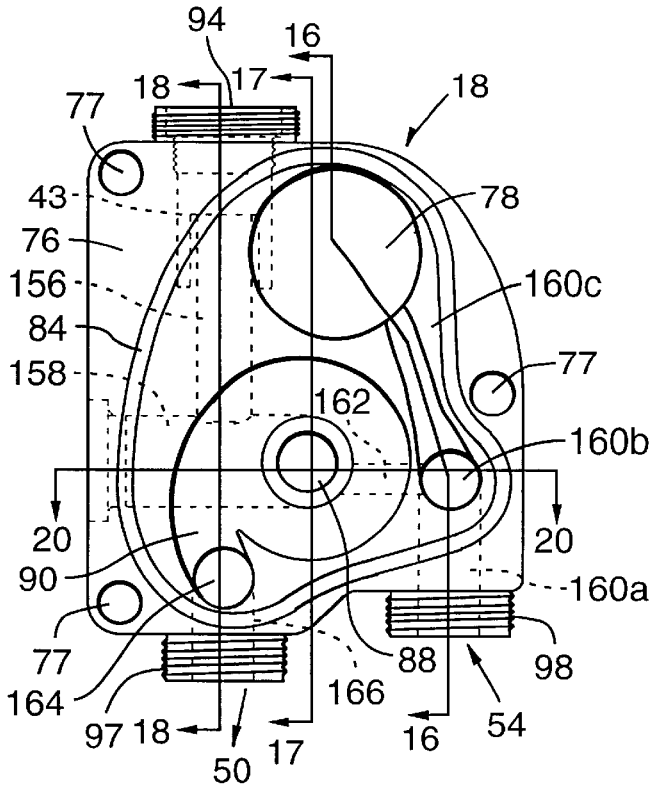
FIG. 12 is a side view of a master module.
Figure 15:
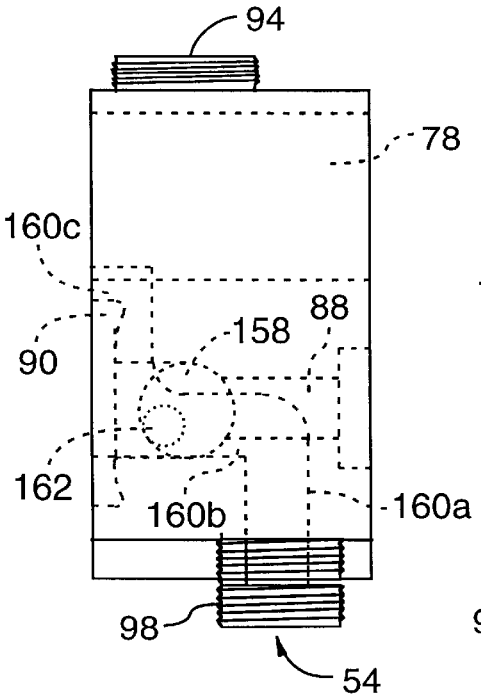
FIG. 15 is a front view of the master module.
Figure 14:
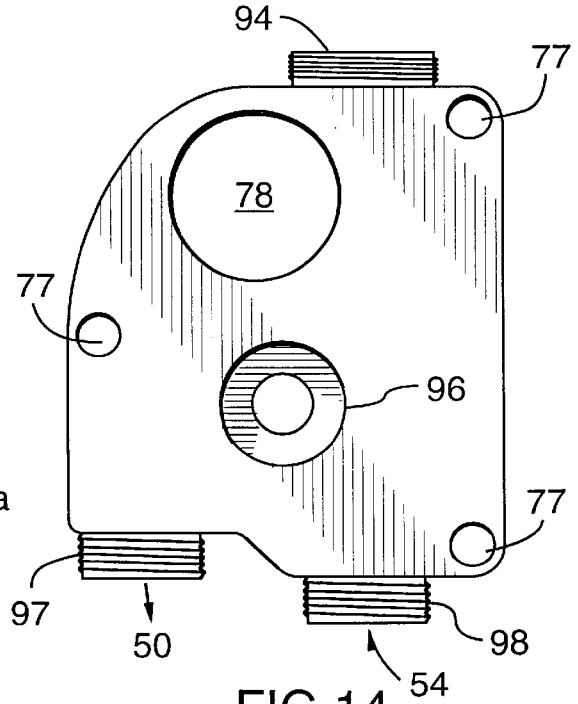
FIG. 14 is an opposite side view of the master module.

FIG. 11 shows the return flow in the upper manifold assembly of FIG. 1. Return water in passage 54 passes into the master module 18 and either flows to the impeller 46 through a passage 152 (equivalent to passage 56 in FIG. 2), as will be shown in more detail later, or is returned to conduit 78, i.e. primary loop 14. In the slave module 26, return water in passage 62 is returned to the return flow in an adjacent master module 18.

Figure 16:
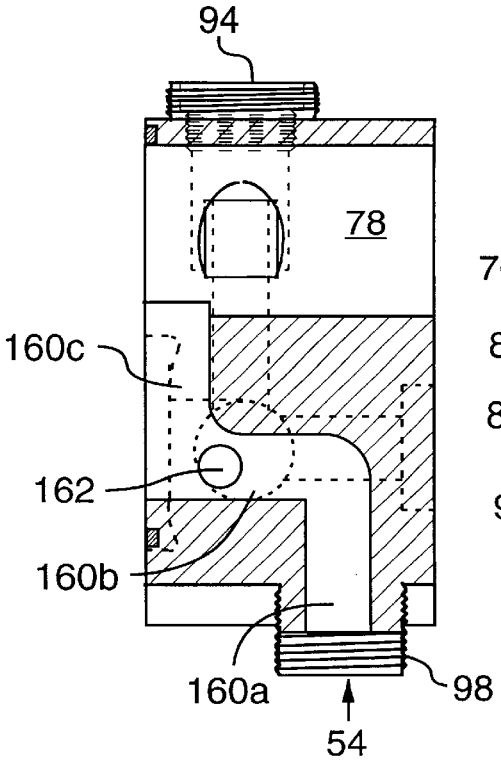
FIG. 16 is a sectional view of the master module taken along the line 16—16 of FIG. 12.
Figure 16A:
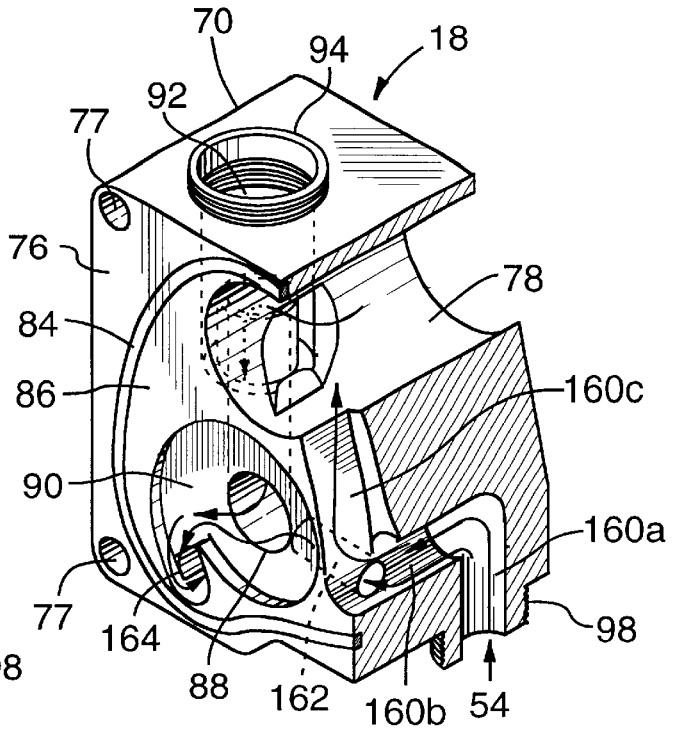
FIG. 16*a* is a perspective view, partly broken away, of the master module showing features shown in FIG. 16.
Figure 17:
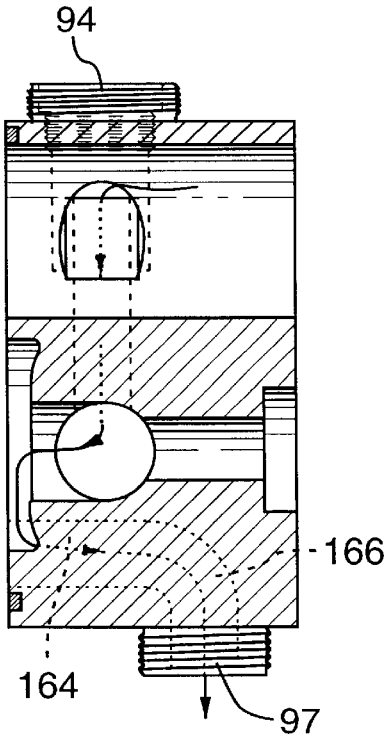
FIG. 17 is a sectional view of the master module taken along the line 17—17 of FIG. 12.
Figure 17A:
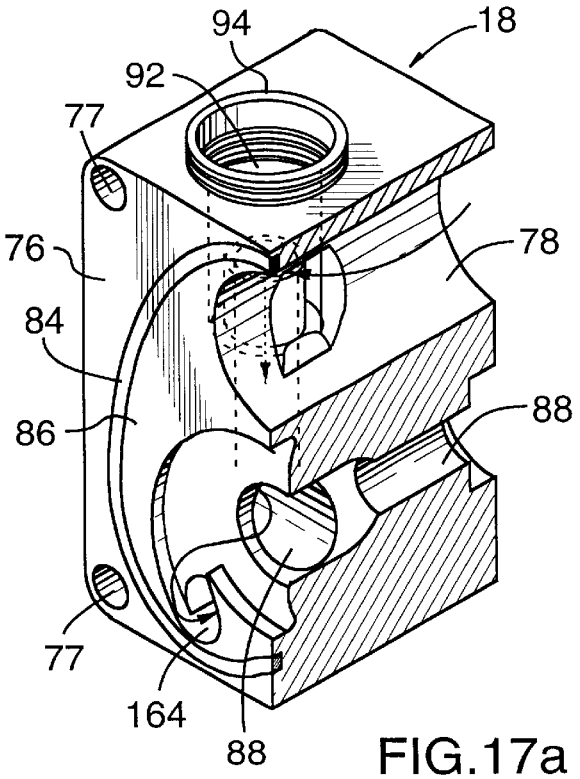
FIG. 17*a* is a perspective view, partly broken away, of the master module showing features shown in FIG. 17.
Figure 18:
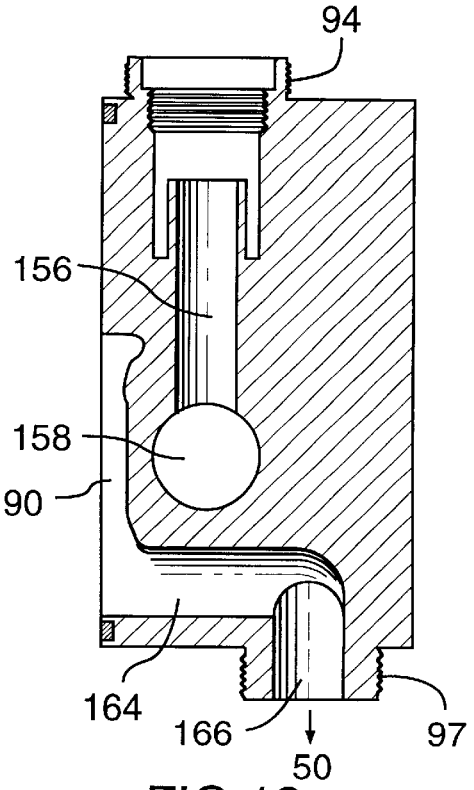
FIG. 18 is a sectional view of the master module taken along the line 18—18 of FIG. 12.
Figure 18A:
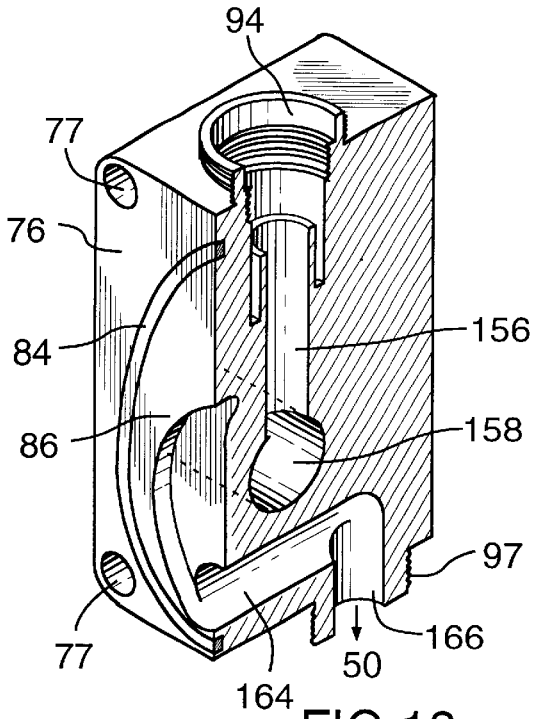
FIG. 18*a* is a perspective view, partly broken away, of the master module showing features shown in FIG. 18.
Figure 20:
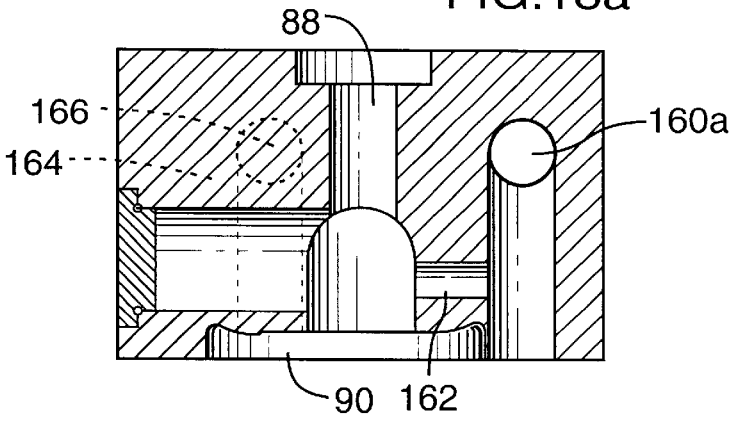
FIG. 20 is a sectional view of the master module taken along the line 20—20 of FIG. 12.
Figure 20A:
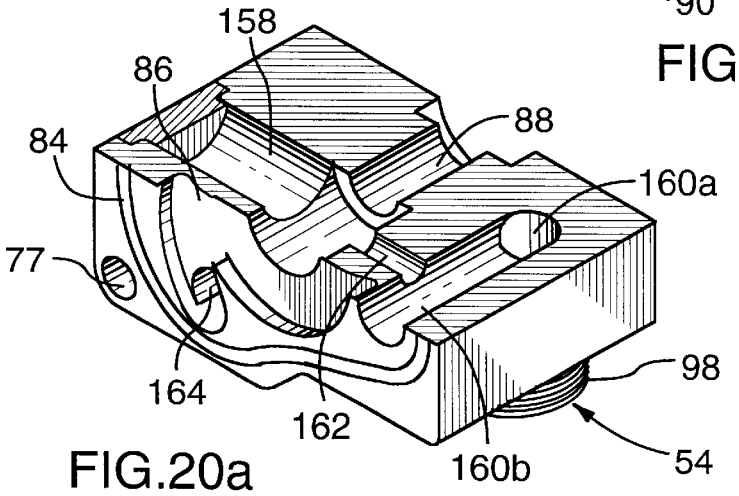
FIG. 20*a* is a partly broken away perspective view of the master module showing features shown in FIG. 20.
Figure 22:
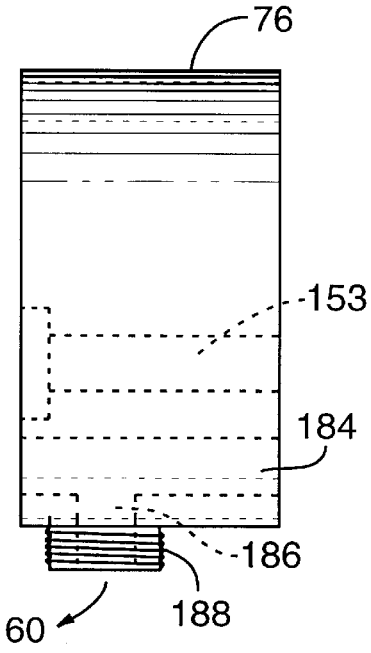
FIG. 22 is a rear view of the slave module.
Figure 21:
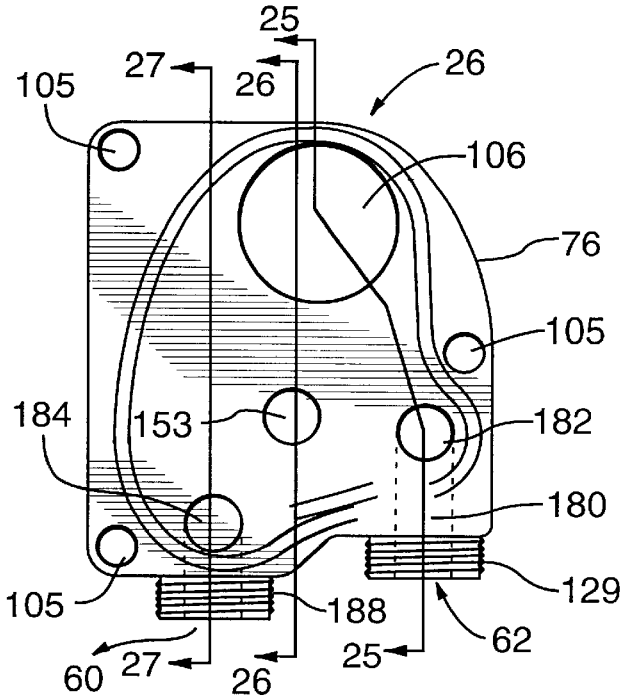
FIG. 21 is a side view of a slave module.
Figure 24:
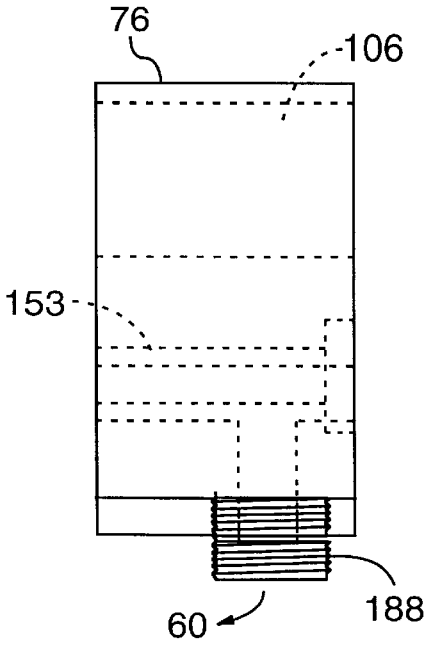
FIG. 24 is a front view of the slave module.
Figure 23:
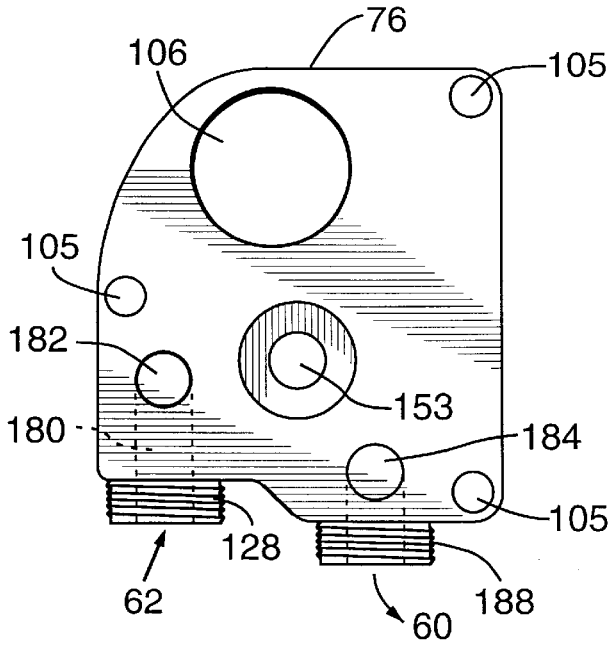
FIG. 23 is an opposite side view of the slave module.
Figure 25:
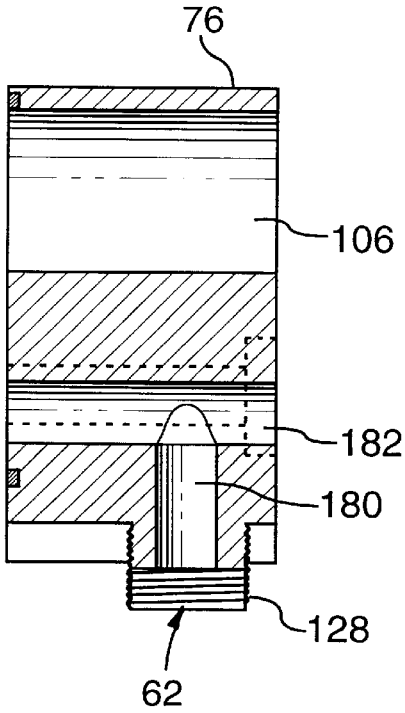
FIG. 25 is a sectional view of the slave module taken along the line 25—25 of FIG. 21.
Figure 25A:
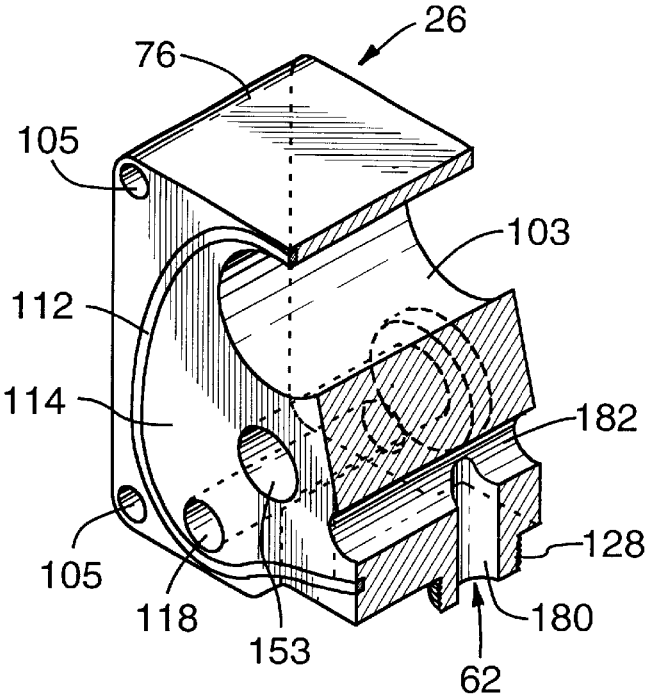
FIG. 25*a* is a broken away perspective view of the slave module showing features shown in FIG. 25.
Figure 26:
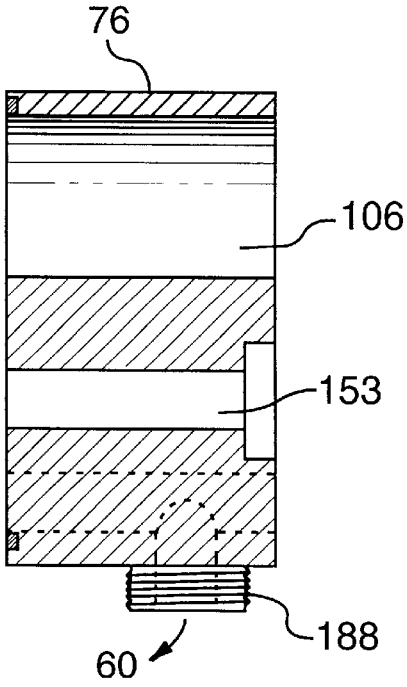
FIG. 26 is a sectional view of the slave module taken along the line 26—26 of FIG. 21.
Figure 27:
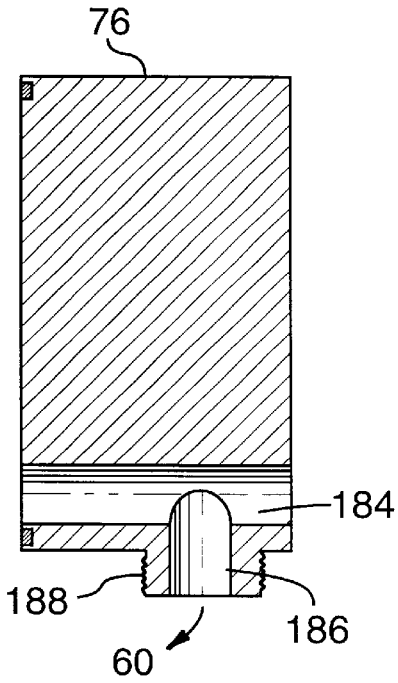
FIG. 27 is a sectional view of the slave module taken along the line 27—27 of FIG. 21.

Further details of the construction of the master module 18 are shown in FIGS. 12 through 19*c*. Hot water in the primary loop 14 flows through the conduit 78 and, if the injection valve 42 is open, some hot water flows from the primary loop 14 through the valve 42 down a vertical passage 156 (see especially FIG. 19) and through a cross-passage 158 to the port 88 leading to the input of impeller 46. Some of the return flow from passage 54 flows through passages 160*a*, 160*b* & 160*c* back to the passage 78, i.e. the primary loop 14 (see especially FIG. 16*a*). Most of the return water flows from passage 160*b* through a passage 162 to passage 88 where it merges with the flow from the injection valve 42 to the impeller 46. After passing impeller 46, the hot water passes through passage 164 (see especially FIG. 18*a*) and then through passage 166 to connector 97 and supply passage 50, 60 leading from master and slave modules 18, 26 to the terminal units.

Figure 19:
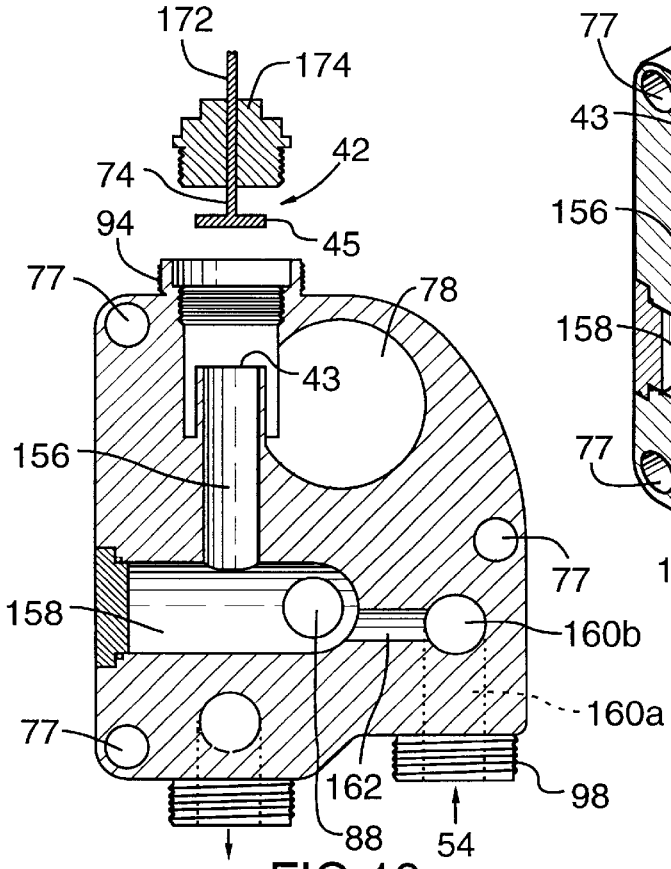
FIG. 19 is a sectional view of the master module taken along the line 19—19 of FIG. 13 and also showing a sectional view of a primary injection valve.
Figure 19C:
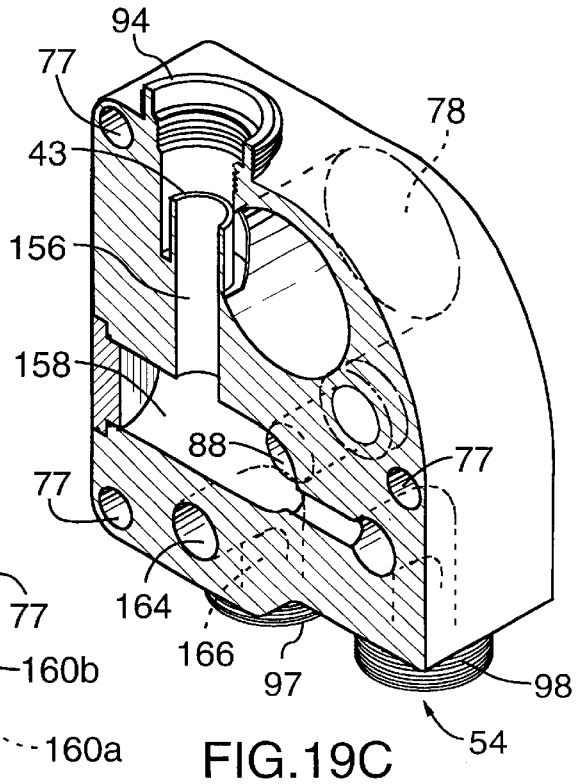
FIG. 19*c* is a sectional perspective view showing features shown in FIG. 19.
Figure 19A:
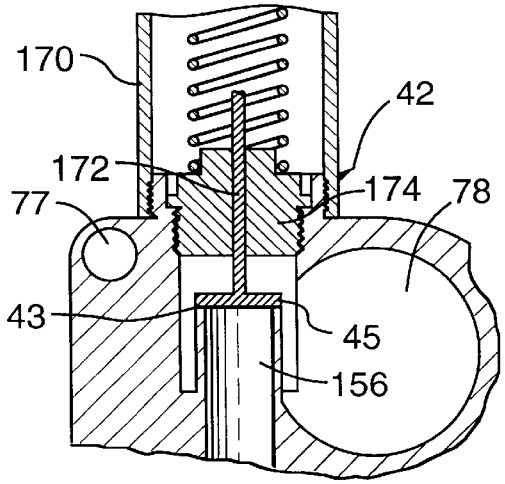
FIG. 19*a* is an enlarged view of the upper part of FIG. 19 showing the injection valve in the closed portion.
Figure 19B:
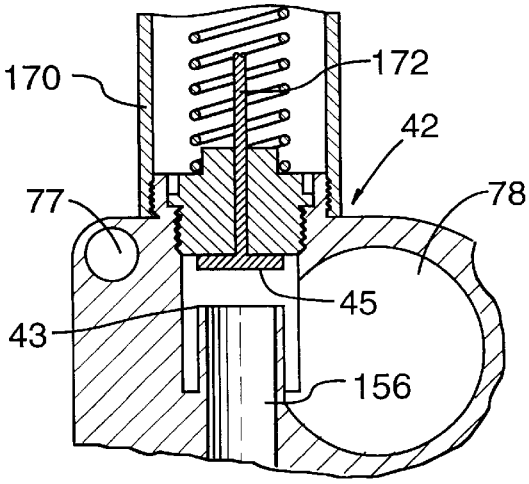
FIG. 19*b* is a similar view but showing the injection valve fully open.

Further details of the injection valve 42 are shown in FIGS. 19 and 19*c*. Injection valve 42 comprises a valve seat 43 at the upper end of passage 156 and a valve member 45 which is movable relative to the valve seat 43 by motor 44. Motor 44 is mounted in screw-threaded engagement with a housing 170 secured to collar 94 of master module body 70. Valve member 45 is carried by a rod 172 which slides in a mounting member 174 screwed into the collar 94. Rod 172 is connected to motor 44 such that a portion of the motor 44 slides rod 172 in mounting member 147 with consequent raising or lowering of the valve member 45 relative to the valve seat 43. Motor 44 is thermostatically controlled to ensure that the space to be heated is maintained at a desired temperature in a manner which will be readily apparent to a person skilled in the art from the foregoing description.

Further details of a slave module 26 are shown in FIGS. 21 through 27. Return pipe 62 is connected to collar 128 so that return water flows up a passage 180 and along longitudinal passage 182 to connect with passage 160*b* in an adjacent master module 18. Supply water is fed from passage 164 of an adjacent master module 18 to slave module port 124 and a longitudinal passage 184 and then a passage 186 where supply pipe 60 is connected to a collar 188.

Figure 28:
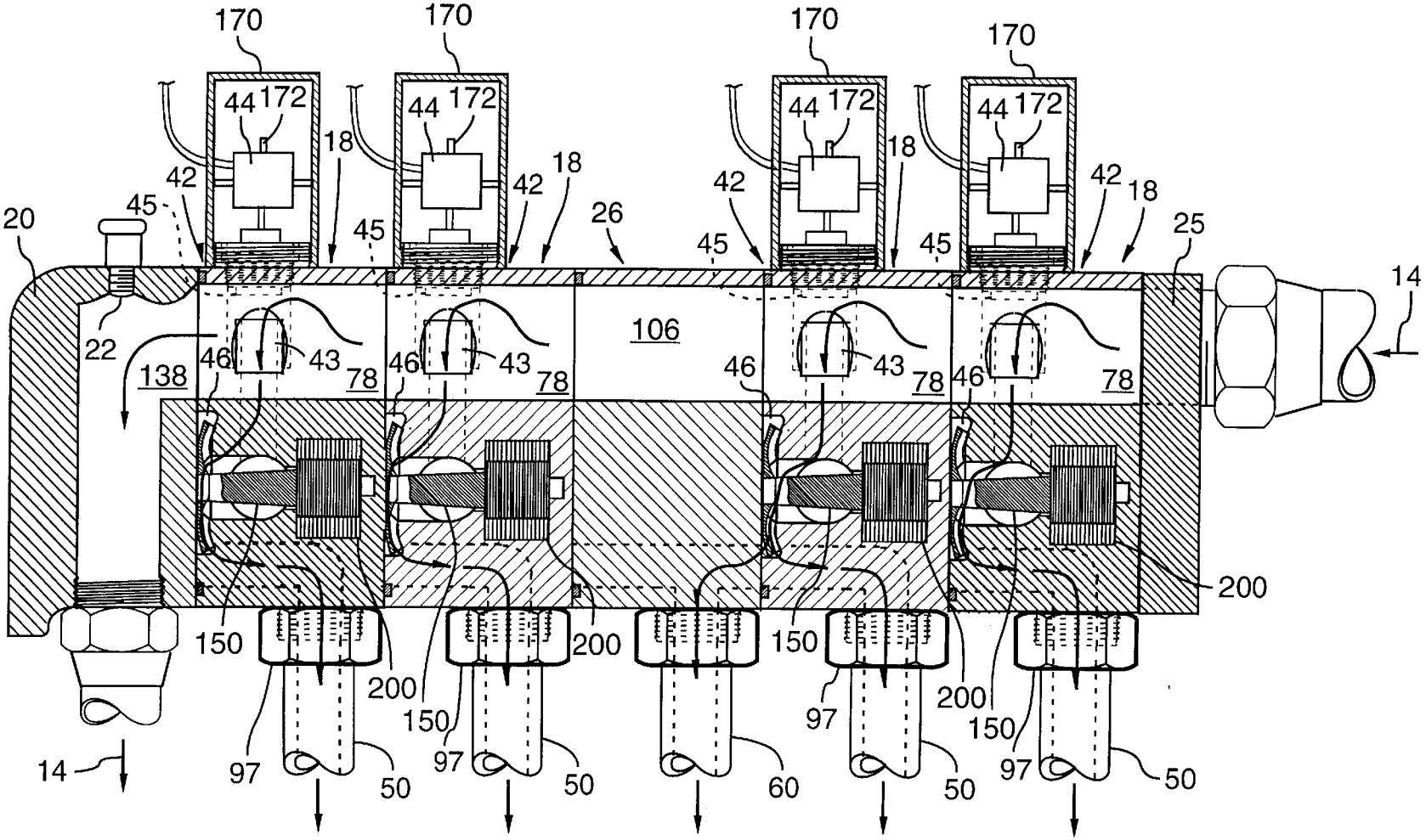
FIG. 28 is a longitudinal sectional view of a manifold assembly similar to FIG. 10 but showing a further embodiment of the invention.

FIG. 28 shows a modification of the manifold assembly shown in FIG. 10. In this embodiment, each impeller 46 is driven by separate motors 200 instead of by one motor 24 and mechanically coupled shafts 150.

Figure 29:
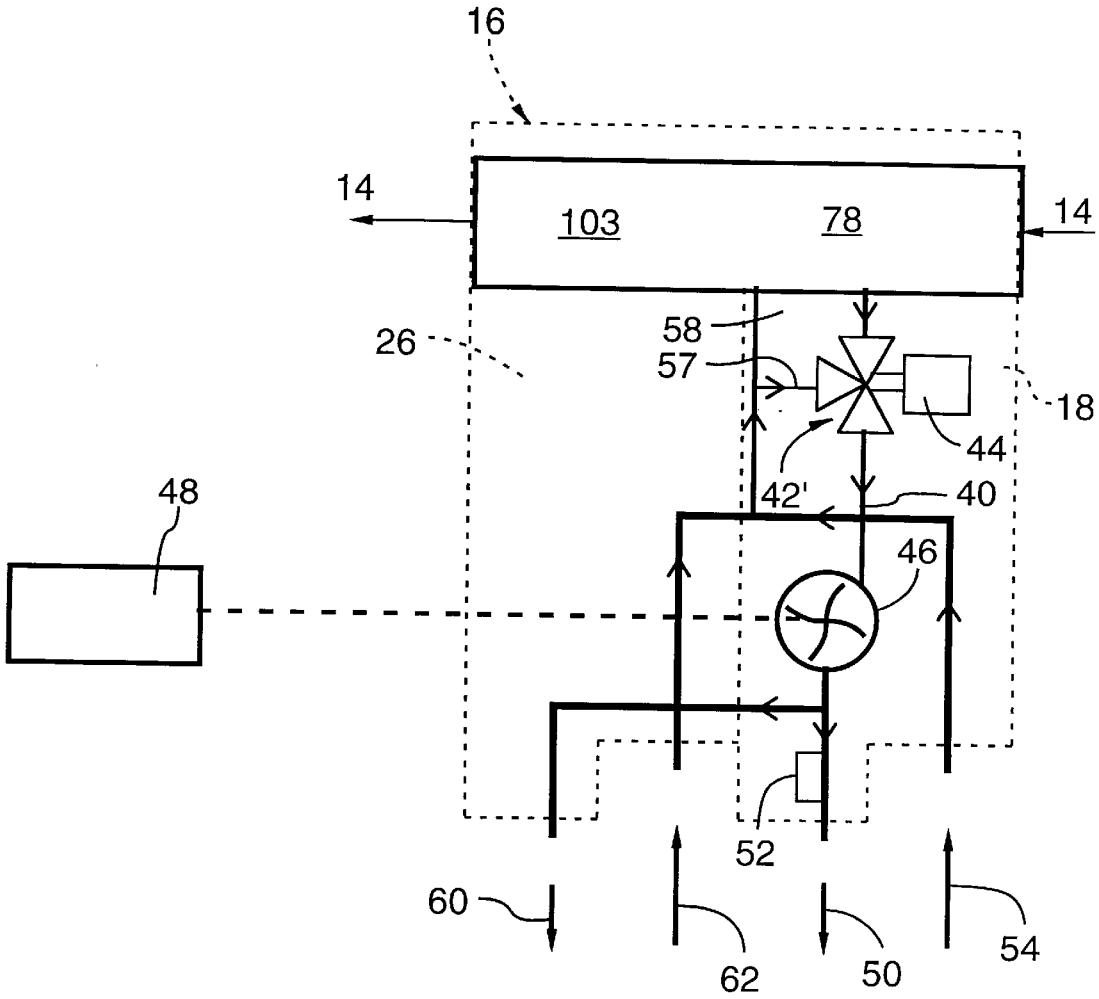
FIG. 29 is a schematic view of the hydronic circuit associated with master and slave modules in a manifold assembly in accordance with another embodiment of the invention.

FIG. 29 shows a hydronic circuit associated with the master and slave modules 18, 26 in accordance with another embodiment of the invention. Instead of the return water being recycled to the impeller 46 through passage 56 as in the hydronic circuit shown in FIG. 2, return passage 56 is omitted and the injection valve 42' operates, under the control of motor 44, to maintain a constant rate of flow of hot water to the impeller 46 at the desired temperature by varying the amount of hot water from the conduit 78 in primary loop 14 relative to the amount of cooler water from return passage 58 supplied to the injection valve 42' through passage 57. Otherwise, the system functions in the same manner as previously described.

Other embodiments of the invention will be readily apparent to a person skilled in the art, the scope of the invention being defined in the appended claims.

The embodiments of the invention in which an exclusive property or privilege is claimed are defined as follows:

1. A modular manifold for use in a water heat distribution system comprising:

I. a master module having:

(a) a main body portion having:

(i) a continuous outer surface extending laterally between a first generally planar side face and a second generally planar side face oriented substantially parallel to one another at opposite lateral ends of said main body portion;

(ii) a first hot water supply conduit formed within said main body portion in fluid communicating relation between an inlet port positioned on said first side face and an outlet port positioned on said second side face;

(iii) a water mixing chamber formed within said main body portion;

(iv) a second hot water supply conduit formed within said main body portion in fluid communicating relation with said first hot water supply conduit and said mixing chamber;

(v) a cold water return conduit formed within said main body portion in fluid communicating relation with a cold water return pipe connecting means positioned on said outer surface of the main body portion and said water mixing chamber;

(vi) a temperate water supply conduit formed within said main body portion in fluid communicating relation with said water mixing chamber and a temperate water outlet pipe connecting means positioned on said outer surface of the main body portion;

(b) a valve means positioned within said second hot water supply conduit to control the flow of hot water through said second hot water supply conduit to said mixing chamber;

(c) an impeller means rotatably mounted within the main body portion in fluid communication with the mixing chamber for drawing water from said second hot water supply conduit and from said cold water return conduit into said mixing chamber for commingling thereof, and for inducing the water so commingled to pass, under positive pressure, from said mixing chamber into said temperate water supply conduit;

II. a drive means mounted on the manifold and operatively connected to said impeller means for driving rotation thereof;

III. a first end module selectively matable to said first generally planar side face in fluid sealing relation thereto, said first end module having a hot water supply throughpassage formed in the first end module in fluid communicating relation with the inlet port of said first hot water supply conduit when said first end module is mated to said first generally planar side face, and a pipe connecting means mounted on an exterior surface of said first end module in fluid communication with said hot water supply throughpassage; and IV. a second end module selectively matable to said second generally planar side face in fluid sealing relation thereto, said second end module having a hot water output throughpassage formed in the second end module in fluid communicating relation with the outlet port of said first hot water supply conduit when said second end face is mated to said second generally planar side face, and a pipe connecting means mounted on an exterior surface of said second end module in fluid communication with said hot water output throughpassage.

2. A modular manifold according to claim 1, wherein a balancing conduit is formed within said main body portion in fluid communicating relation with said first hot water supply conduit and with said cold water return conduit.

3. A modular manifold according to claim 2, wherein said main body portion is formed as a unitary molded structure.

4. A modular manifold according to claim 3, wherein said impeller means is rotatably mounted within an impeller volute formed within the main body portion with a first lateral extent of said volute in fluid communication with said mixing chamber and a second lateral extent of said volute opening onto said second generally planar side face so as to be laterally limited by an internal face of said second end module, when attached.

5. A modular manifold according to claim 4, wherein said cold water return conduit is formed within said main body portion with a lateral extension thereof opening onto said second generally planar side face so as to be laterally limited by said internal face of said second end module, when mated thereto.

6. A modular manifold according to claim 5, wherein said balancing conduit is formed within said main body portion with a lateral extent of said balancing conduit opening onto said second generally planar side face so as to be laterally limited by said internal face of said second end module, when melted thereto.

7. A modular manifold according to claim 6, wherein said impeller means is rotatably mounted within the main body portion as aforesaid by operative connection to a drive shaft journalled within the main body portion.

8. A modular manifold according to claim 7, wherein said drive means is mounted on the second end module.

9. A modular manifold according to claim 8, wherein said drive means comprises an electric motor.

10. A modular manifold according to claim 9, wherein said electric motor is a variable speed electric motor.

11. A modular manifold according to claim 10, wherein an electrical control means is mounted on the master module to selectively open and close said valve means from a remote location.

12. A modular manifold according to claim 11, wherein a transducer means is mounted on the master module in operative contacting relation with said temperate water supply conduit for monitoring the temperature of water in said temperate water supply conduit, for producing an electrical signal indicative of such temperature, and sending such signal to a remote location.

13. A modular manifold according to claim 12, wherein a first and of said driven shaft extends beyond said second generally planar side face into a recess defined within said second end module whereat said first end is operatively connected to said drive means when said second end module is attached to said second side face.

14. A modular manifold according to claim 13, wherein an air vent means is positioned on said second end module in fluid communication with said hot water output throughpassage so as to provide for the venting of air accumulated within said hot water output throughpassage to atmosphere.

15. A modular manifold according to claim 6, wherein said drive means is mounted within the main body portion in operative connection to said driven shaft.

16. A modular manifold according to claim 3, wherein there is provided a plurality of master modules selectively matable one to the other in laterally extending relation to form a flow of master modules having first and second row ends defined, respectively, by the first generally planar side face of a first terminal one of said plurality of master modules, and by a second generally planar side face of a second terminal one of said plurality of master modules;

with each second generally planar side face internal to said row sealingly mating with a first generally planar side face internal to said row, with the inlet port of each such internally mating first generally planar side face being in fluid communicating relation with the respective outlet port of each such internally mating second side face;

with the first end module being selectively matable to the first generally planar side face of the first terminal one of said master modules, in fluid sealing relation thereto, with the outlet port of said first end module being in fluid communication with the inlet port on said first generally planar side face of said first terminal one of said master modules, when so mated thereto; and with the second end module being selectively matable to the second generally planar side faces of the second terminal one of said master modules in fluid sealing relation thereto, with the hot water output throughpassage of said second end module being in fluid communication with the outlet port on said second generally planar side face of said second terminal one of said master modules, when so mated thereto.

17. A modular manifold according to claim 16, wherein a separate drive means is mounted on each of said plurality of master modules in operative connection to the respective impeller means of each such master module for driving rotation thereof.

18. A modular manifold according to claim 17, wherein each of said drive means comprises an electric motor.

19. A modular manifold according to claim 18, wherein each of said electric motors is a variable speed electric motor.

20. A modular manifold according to claim 16, wherein said drive means is mounted on the second end module, and is operatively connected to a first free end of the driven shaft of the second terminal one of said plurality of master modules, which free end extends beyond the second generally planar side face of the second terminal one of said plurality of master modules into a recess defined within said second end module to effect such connection, and wherein said driven shaft is in turn connected at its opposite other end, in end to end serial driving relation, with each of the remainder of driven shafts journalled in the other of said plurality of master modules forming said row, thereby collectively, rotatably driving each such impeller means from said drive means mounted on the second end module.

21. A modular manifold according to claim 18, wherein a separate electrical control means is mounted on each one of said plurality of master module to selectively open and close the respective valve means associated with each of said master modules from a remote location.

22. A modular manifold according to claim 21, wherein a separate transducer means is mounted on each of said plurality of master modules in operative contacting relation with the respective temperate water supply conduit associated with each master module for monitoring the temperature of water in said conduit, for producing an electrical signal indicative of such temperature, and for sending such signal to a remote location.

23. A modular manifold according to claim 3, additionally comprising a slave module removable interposed between said master module and said second end module, said slave module comprising:

(a) a slave body portion having:

(i) a continuous outer surface extending laterally between a first generally planar slave side face and a second generally planar slave side face oriented substantially parallel to one another at opposite lateral ends of said slave body portion;

(ii) a slave hot water supply conduit formed within said body portion in fluid communicating relation between a slave inlet port positioned on said first generally planar slave side face and a slave outlet port positioned on said second generally planar slave side face;

(iii) a slave cold water return conduit formed within said slave body portion in fluid communicating relation with a slave cold water return pipe connecting means positioned on said outer surface of the slave body portion and with a slave cold water return port positioned on said first generally planar side slave face;

(iv) a slave temperature water supply conduit formed within said slave body portion in fluid communicating relation with said slave temperate water outlet pipe connecting means positioned on said outer surface of the slave body portion and with a slave temperate water return port positioned on said first generally planar side face;

said second generally planar side face of the master module being selectively matable to said first generally planar side slave face in fluid sealing relation thereto, so as to cause, when so mated, said slave inlet port to be in fluid communication with said outlet port positioned on the second side face of the master module, said slave cold water return port to be in fluid communication with said lateral extension of said cold water return conduit of the master module, and said slave temperate water supply conduit to be in fluid communication with said second lateral extent of said impeller volute; and said second end module being selectively attachable to said second generally planar slave side face in fluid sealing relation thereto, so as to cause, when so mated, said hot water output throughpassage formed in the second end module to be in fluid communicating relation with said slave outlet port of said slave hot water supply conduit.

24. A modular manifold according to claim 23, wherein said slave body portion is formed as unitary molded structure.

25. A modular manifold according to claim 24, wherein said slave module additionally comprises a slave driven shaft journalled for rotation within the slave body portion and having two opposed ends protruding one each from the first and second generally planar slave side faces, wherein said drive means is mounted on the second end module and is operatively connected to said end of the slave driven shaft producing from the secondary generally planar slave side face to effect such connection, and wherein the slave driven shaft is in turn connected at its opposite other end protruding from the first generally planar slave side face, in end to end serial driving relation, with the driven shaft of the master module, thereby providing for driving rotation of the impeller means of the master module by said drive means mounted on the second end module.

26. A modular manifold according to claim 25, wherein a separate electrical control means is mounted on each one of said plurality of master modules to selectively open and close the respective valve means associated with each of said maser modules from a remote location.

27. A modular manifold according to claim 26, wherein a separate transducer means is mounted on each of said plurality of master modules in operative contacting relation with the respective temperate water supply conduit associated with each master module for monitoring the temperature of water in said conduit, for producing an electrical signal indicative of such temperature, and for sending such signal to a remote location.

28. A modular modified according to claim 16, additionally comprising a slave module removably interposed between two adjacent ones of said plurality of master modules, said slave module comprising:

(a) a slave body portion having:

(i) a continuous outer surface extending laterally between a first generally planar slave side face and a second generally planar slave side face oriented substantially parallel to one another at opposite lateral ends of said slave body portion;

(ii) a slave hot water supply conduit formed within said body portion in fluid communicating relation between a slave inlet port positioned on said first slave side face and a slave outlet port positioned on said second slave side face;

(iii) a slave cold water return conduit formed within said slave body portion in fluid communicating relation with a slave cold water return pipe connecting means positioned on said outer surface of the slave body portion and with a slave cold water return port positioned on said first generally planar side slave face;

(iv) a slave temperate water supply conduit formed within said slave body portion in fluid communicating relation with said slave temperate water outlet pipe connecting means positioned on said outer surface of the slave body portion and with a slave temperate water return port positioned on said first generally planar side face;

with the second generally planar side face of one of said two adjacent master modules being selectively matable to the first generally planar slave side face of said slave module, in fluid sealing relation thereto, so as to cause, when so mated, the slave inlet port on said first generally planar slave side face of said slave module to be in fluid communication with said outlet port on said second generally planer side face of said one master module, said slave cold water return port to be in fluid communication with said lateral extension of said cold water return conduit of said one master module, and said slave temperate water supply conduit to be in fluid communication with said second lateral extent of said impeller volute of said one master module; and with the first generally planar side face of the other of said two adjacent master modules being selectively matable to the second generally planar slave side face of said slave module, in fluid sealing relation thereto, so as to cause, when so mated, the slave outlet port on said second generally planar slave side face of said slave module to be in fluid communication with the inlet port on the first generally planar side face of said other master module.

29. A modular manifold according to claim 28, wherein a separate drive means is mounted on each of said plurality of master modules in operative connection to the respective impeller means of each such master module for driving rotation thereof.

30. A modular manifold according to claim 29, wherein each of said drive means comprises an electric motor.

31. A modular manifold according to claim 30, wherein each of said electric motors is a variable speed electric motor.

32. A modular manifold according to claim 29, wherein said slave body portion is formed as a unitary molded structure.

33. A modular manifold according to claim 32, wherein said slave module additionally comprises a slave driven shaft journalled for rotation within the slave body portion and having two opposed ends protruding one each from the first and second generally planar slave side faces, wherein said drive means is mounted on the second end module and is operatively connected to a first free end of the driven shaft of the second terminal one of said plurality of master modules, which free and extends beyond the second generally planar side face of the second terminal one of said plurality of master modules into a recess defined within said second end module to effect such connection, and wherein said driven shaft is in turn connected at its opposite other end, in end to end serial driving relation, with each of the remainder of the driven shafts and with the slave driven shaft, thereby collectively, rotatably driving each such impeller means from said drive means mounted on the second end module.

34. A modular manifold according to claim 33, wherein a separate electrical control means is mounted on each one of said plurality of master modules to selectively open and close the respective valve means associated with each of said maser modules from a remote location.

35. A modular manifold according to claim 34, wherein a separate transducer means is mounted on each of said plurality of master modules in operative contacting relation with the respective temperate water supply conduit associated with each master module for monitoring the temperature of water in said conduit, for producing an electrical signal indicative of such temperature, and for sending such signal to a remote location.

* * * * *